US006364547B1

(12) United States Patent
Matsuyama et al.

(10) Patent No.: US 6,364,547 B1
(45) Date of Patent: Apr. 2, 2002

(54) SOLUTION PROCESSING APPARATUS

(75) Inventors: Yuji Matsuyama; Shuichi Nagamine, both of Kikuchi-gun (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/694,198

(22) Filed: Oct. 23, 2000

(30) Foreign Application Priority Data

Oct. 25, 1999 (JP) ..... 11-302033

(51) Int. Cl.[7] ..... G03D 3/02; G03D 5/00

(52) U.S. Cl. ..... 396/611; 396/627; 118/52; 427/240

(58) Field of Search ..... 396/611, 627; 118/52, 319–321, 500, 666–670, 712, 716; 134/34, 157, 902; 427/24 D

(56) References Cited

U.S. PATENT DOCUMENTS 5,252,137 A 10/1993 Tateyama et al. ..... 134/34

5,854,943 A 12/1998 Semba ..... 396/611

FOREIGN PATENT DOCUMENTS

JP 10-270336 A * 10/1998

OTHER PUBLICATIONS

U.S. Patent Application filed Oct. 25, 2000, Solution Processing Apparatus, Assigned to Tokyo Electron Limited (Serial Number not yet received).

* cited by examiner

*Primary Examiner*—D. Rutledge
(74) *Attorney, Agent, or Firm*—Fulbright & Jaworski L.L.P.

(57) ABSTRACT

Discharge ports of a supply nozzle are structured to be able to discharge a processing solution in a horizontal direction, and a guide plate for reducing the discharge pressure of the processing solution and guiding the processing solution to an under substrate is provided at a position facing the discharge ports. Thus, the appearance of micro bubbles at the time of the supply of the processing solution to the surface of the substrate can be inhibited, thereby reducing poor developing.

21 Claims, 14 Drawing Sheets

FIG.6A
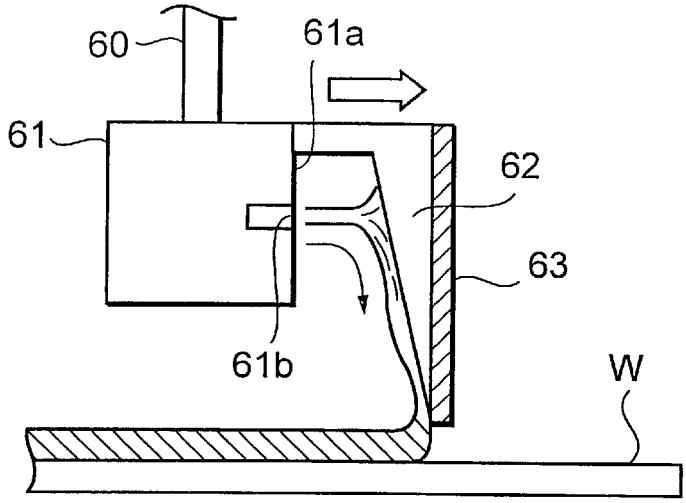
FIG.6B
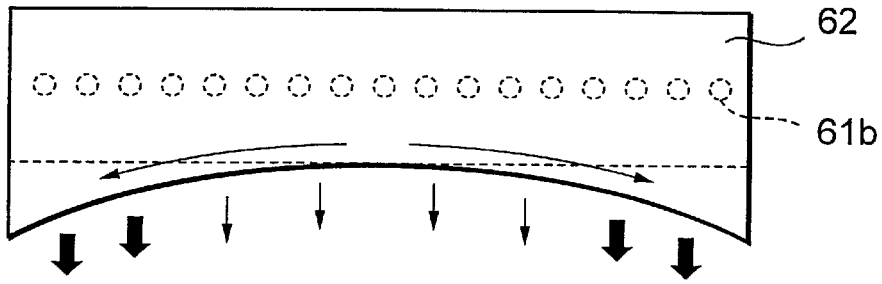
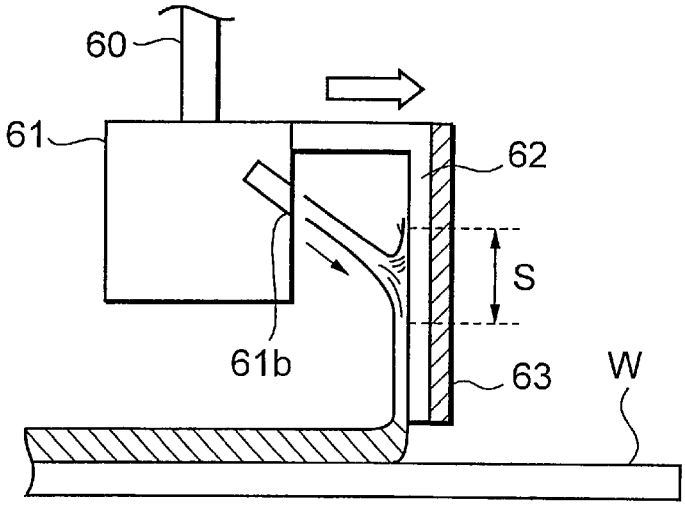
FIG.7

SOLUTION PROCESSING APPARATUS

CROSS-REFERENCE TO RELATED APPLICATIONS

This application is based upon and claims the benefit of priority from the prior Japanese Patent Application No. 11-302033, filed Oct. 25, 1999, the entire contents of which are incorporated herein by reference.

BACKGROUND OF THE INVENTION

The present invention relates to a solution processing apparatus, for example, for supplying a developing solution to the surface of a substrate coated with a resist and subjected to exposure processing to perform developing processing.

A mask for forming a circuit pattern on the surface of a semiconductor wafer (hereinafter referred to as a wafer) or an LCD substrate of a liquid crystal display is formed by the following process. Namely, a photo-resist solution (hereinafter referred to as a resist) is first applied on the surface of the wafer, and light or the like is irradiated on the photo resist film. If the resist is negative, for example, a portion exposed to the light is cured, and a portion which is not cured, that is, a portion in which the resist is easily soluble, is dissolved by a developing solution, thereby forming a desired mask. A developing processing apparatus includes a spin chuck for rotating the wafer while suction-holding it and a developing solution supply nozzle for supplying a developing solution to the wafer on the spin chuck.

As a developing solution supply nozzle used in the aforesaid developing process, a supply nozzle in which a large number of discharge ports are arranged over a length corresponding to the diameter of the wafer has been hitherto used.

In the developing process by means of this supply nozzle, the center of the wafer is first vacuum-sucked and horizontally held by the spin chuck. The supply nozzle is positioned so that the discharge ports are situated, for example, 1 mm higher than the surface of the wafer at a central portion of the wafer, and the wafer is rotated 180 degrees while the developing solution is being supplied to the central portion of the surface of the wafer in a diameter direction from the discharge ports. Thus, the developing solution is spread all over the wafer while being discharged to the central portion over the diameter of the wafer, and heaped up. A the same time, a film of the developing solution with a predetermined thickness is formed on the entire surface of the wafer.

To secure the uniformity of line width, however, the process of heaping up the developing solution on the entire upper face of the wafer has heretofore needed to equalize the total retention time of the heaped developing solution as much as possible. Therefore, it is necessary to apply the developing solution to the wafer quickly, and thus the supply pressure of the developing solution is raised.

According to a conventional developing processing method, however, in view of uniform discharge, the diameter of a discharge port of the developing solution supply nozzle is small, and supply pressure is set at a high pressure, whereby discharge flow velocity becomes high. As a result, there is a possibility that an impact on a portion to be dissolved of the surface of the wafer is strong at the time of initial discharge onto the surface of the wafer, thus lowering the uniformity of line width.

Another method of using the same developing solution supply nozzle and spin chuck as the aforesaid ones is examined. This method is a scan method in which the supply nozzle is moved to the outside of the peripheral edge of the wafer horizontally held by the spin chuck and positioned there, and from this position, moved to the outside of the opposite side of the wafer peripheral edge while discharging the developint solution.

Such a scan method is similar in that the discharge pressure of the developing solution onto a substrate is high, and there is a possibility that micro bubbles appear by an impact caused by the supply of the developing solution to the surface of the substrate. Micro bubbles cause poor developing by touching a pattern on the wafer, and hence it is desirable to inhibit the appearance of micro bubbles as much as possible.

When the wafer is vacuum-sucked from the center of its back side by the spin chuck, a little distortion occurs in the wafer, whereby the developing solution supplied to the surface of the wafer tends to concentrate at the center. Accordingly, a solution film at the central potion of the wafer is thicker than at the edge portion, which causes a problem that line width becomes ununiform.

BRIEF SUMMARY OF THE INVENTION

An object of the present invention is to provide a solution processing apparatus capable of inhibiting the appearance of micro bubbles and reducing poor developing.

Another object of the present invention is to provide a solution processing apparatus capable of uniformly performing solution processing on the surface of a substrate.

According to a first aspect of the present invention, there is provided a solution processing apparatus comprising a substrate holding section which horizontally holds a substrate, a supply nozzle having a plurality of discharge ports which discharge a processing solution, and arranged over a length corresponding to the width of an effective area of the substrate, a moving mechanism which moves the supply nozzle relatively to the substrate in a direction orthogonal to the direction of arrangement of the discharge ports, and a guide member provided opposite to the supply nozzle and guiding the processing solution discharged from the discharge ports to the surface of the substrate, the guide member having a central portion and side portions lowered from the central portion.

According to the aforesaid structure, the processing solution discharged from the supply nozzle is supplied onto the substrate via the guide member, whereby the impact of a collision of the processing solution against the surface of the substrate is alleviated, which, for example, inhibits micro bubbles from appearing on the substrate.

According to a second aspect of the present invention, there is provided a solution processing apparatus comprising a substrate holding section which horizontally holds a substrate, a supply nozzle having a plurality of discharge ports which discharge a processing solution, and arranged over a length corresponding to a width of an effective area of the substrate, a moving mechanism configured to move the supply nozzle relatively to the substrate, and a guide member provided for the supply nozzle and guiding the processing solution discharged from the discharge ports to a surface of the substrate.

According to a third aspect of the present invention, there is provided a solution processing apparatus comprising a substrate holding section configured to horizontally hold a substrate, a supply nozzle having a plurality of discharge ports which discharge a processing solution, and arranged over a length corresponding to a width of an effective area of the substrate, a moving mechanism which moves the supply nozzle relatively to the substrate, and a guide member provided for the supply nozzle to guide the processing solution discharged from the discharge ports to a surface of the substrate, the guide member having a central portion and both end portions lowered than the central portion.

According to the second aspect and the third aspect, since the lower edge portion of the guide member which guides the processing solution discharged from the discharge ports of the supply nozzle to the surface of the substrate is formed so that both the end portions thereof are lower than the central portion, in the supply nozzle, a supply quantity to the edge portion of the substrate is set to be larger than a supply quantity to the central portion thereof. Accordingly, when the processing solution tends to concentrate at the central portion of the substrate by the spin chuck as a substrate holding section, for example, a solution film with high uniformity is formed on the substrate owing to a balance with a phenomenon in which the processing solution tries to concentrate at the central portion of the substrate. Moreover, the processing solution discharged from the supply nozzle is supplied onto the substrate via the guide member, whereby the impact of a collision of the processing solution against the surface of the substrate is alleviated. As a result, for example, micro bubbles are prevented from appearing on the substrate.

Furthermore, when the moving mechanism of a scan method for moving the supply nozzle relatively to the substrate in a direction orthogonal to the direction of arrangement of the discharge ports as in the second aspect is used, the processing solution spills at the edge portion of the substrate to the outside of the substrate. However, part of the processing solution spilling to the outside of the substrate at this time is attracted to the inside of the substrate by the surface tension of the processing solution applied on the surface of the substrate. As a result, a waviness phenomenon occurs on the surface of the substrate, and thus the processing solution concentrates at the central portion of the substrate. Hence, a solution film at the central portion of the substrate becomes thicker than at the edge portion, which causes a problem that line width becomes ununiform. In the supply nozzle, however, a supply quantity to the edge portion of the substrate is set to be larger than a supply quantity to the central portion thereof. As a result, a solution film with high uniformity is formed on the substrate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 6A and 6B are explanatory views showing the operation of the solution processing apparatus of the first embodiment;

FIG. 7 is an explanatory view showing operation of the solution processing apparatus of a second embodiment according to the present invention;

DETAILED DESCRIPTION OF THE INVENTION

Figure 1:
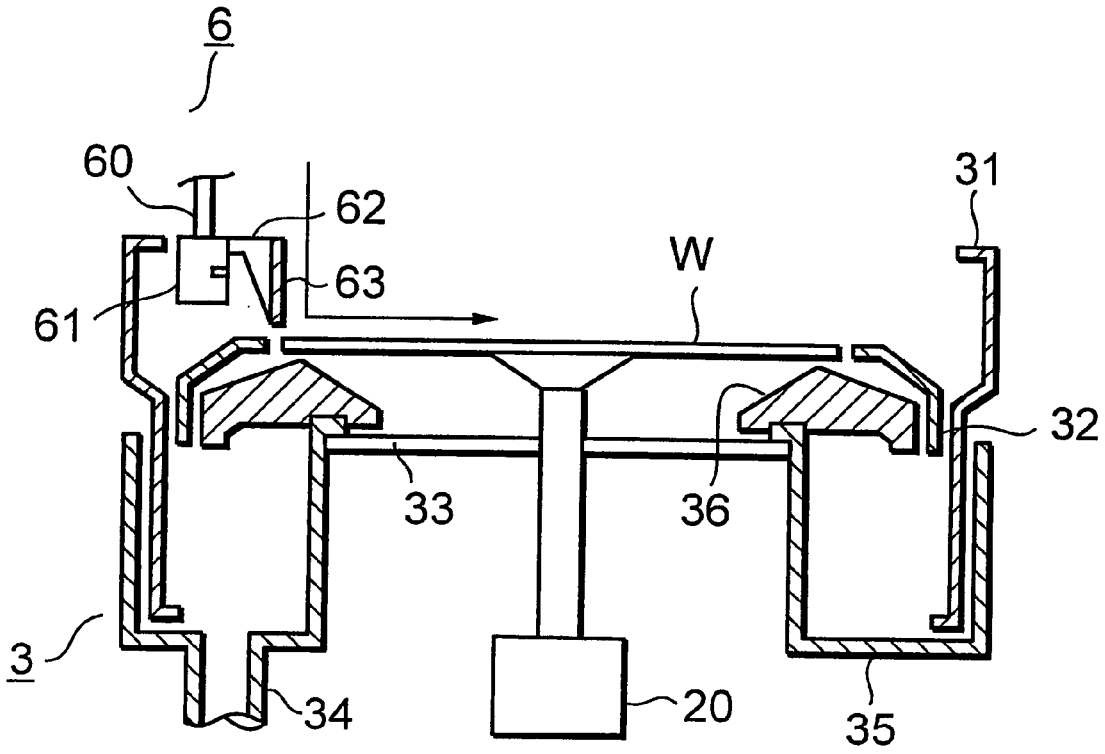
FIG. 1 is a sectional view of a solution processing apparatus of a first embodiment according to the present invention.
Figure 2:
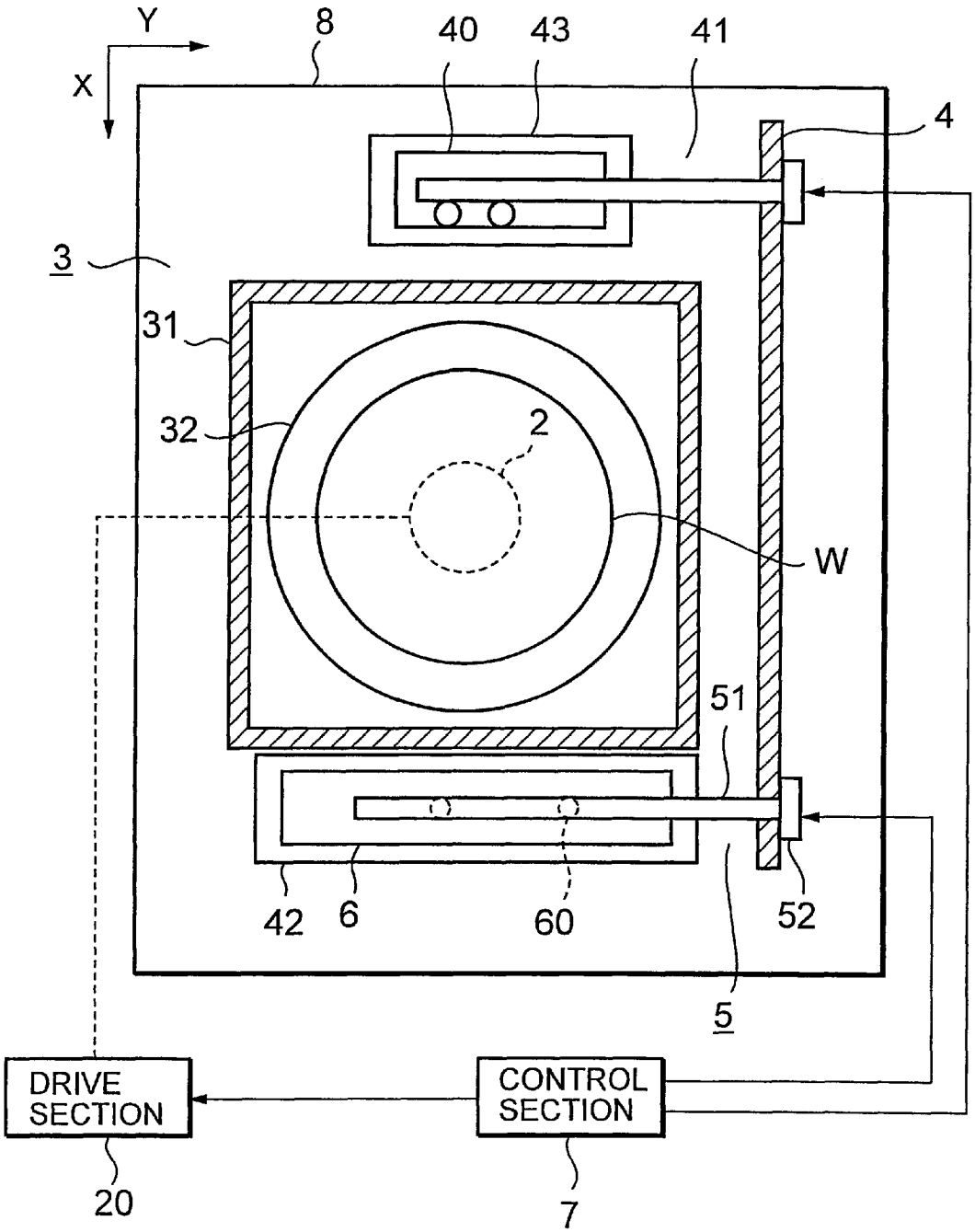
FIG. 2 is a plan view of the solution processing apparatus of the first embodiment according to the present invention.

FIG. 1 and FIG. 2 are schematic views showing a first embodiment in which a solution processing apparatus according to the present invention is applied to a developing apparatus. A spin chuck 2 constitutes a substrate holding section for vacuum-sucking a central portion of the reverse face of a wafer W and holding it horizontally. This spin chuck 2 is structured to be rotatable and ascendable and descendable by a drive section 20.

A cup 3 is provided to surround the side of the wafer W while the wafer W is vacuum-sucked by the spin chuck 2. The cup 3 comprises an outer cup 31 and an inner cup 32 which are movable vertically. The lower portion of the outer cup 31 is formed into a cylindrical shape, and the upper portion thereof is formed into a square pillar shape. The inner cup 32 is formed so that the upper portion of a cylinder inclines radially upward and toward the inner side and that an upper opening is narrower than a lower opening.

The lower portion of the cup 3 has a circular plate 33 surrounding the periphery of the spin chuck 2 and a solution catching section 35 which forms a recessed portion along the entire periphery of the circular plate 33 and in the bottom face of which a drain port 34 is formed. The outer cup 31 (and the inner cup 32) are housed within the side face of the solution catching section 35 but very close to it, and the recessed portion and the cup 3 surround the side of the wafer ranging from the upper level to the lower level of the wafer W. A ring body 36 having a mountain-shaped section, the upper end of which is very close to the back surface of the wafer W, is provided at a peripheral edge portion of the circular plate 33.

Next, the outside of the cup 3 will be explained. As shown in FIG. 2, a guide rail 4 extending in an X-direction, for example, so as to be parallel to one side of the upper portion of the outer cup 31 is provided. In a state shown in FIG. 2, a first moving mechanism 5 for moving a supply nozzle 6 is positioned on one end side of the guide rail 4, and a second moving mechanism 41 for moving a cleaning nozzle 40 is provided on the other end side thereof. These moving mechanisms 5 and 41 are structured to be movable above the wafer W with being guided by the guide rail 4. In FIG. 2, the first moving mechanism 5 and the second moving mechanism 41 are positioned at waiting sections 42 and 43 for the first moving mechanism 5 and the second moving mechanism 41 when they are not operated. The waiting sections are each constructed by, for example, a vertically movable plate-shaped body.

Figure 3:
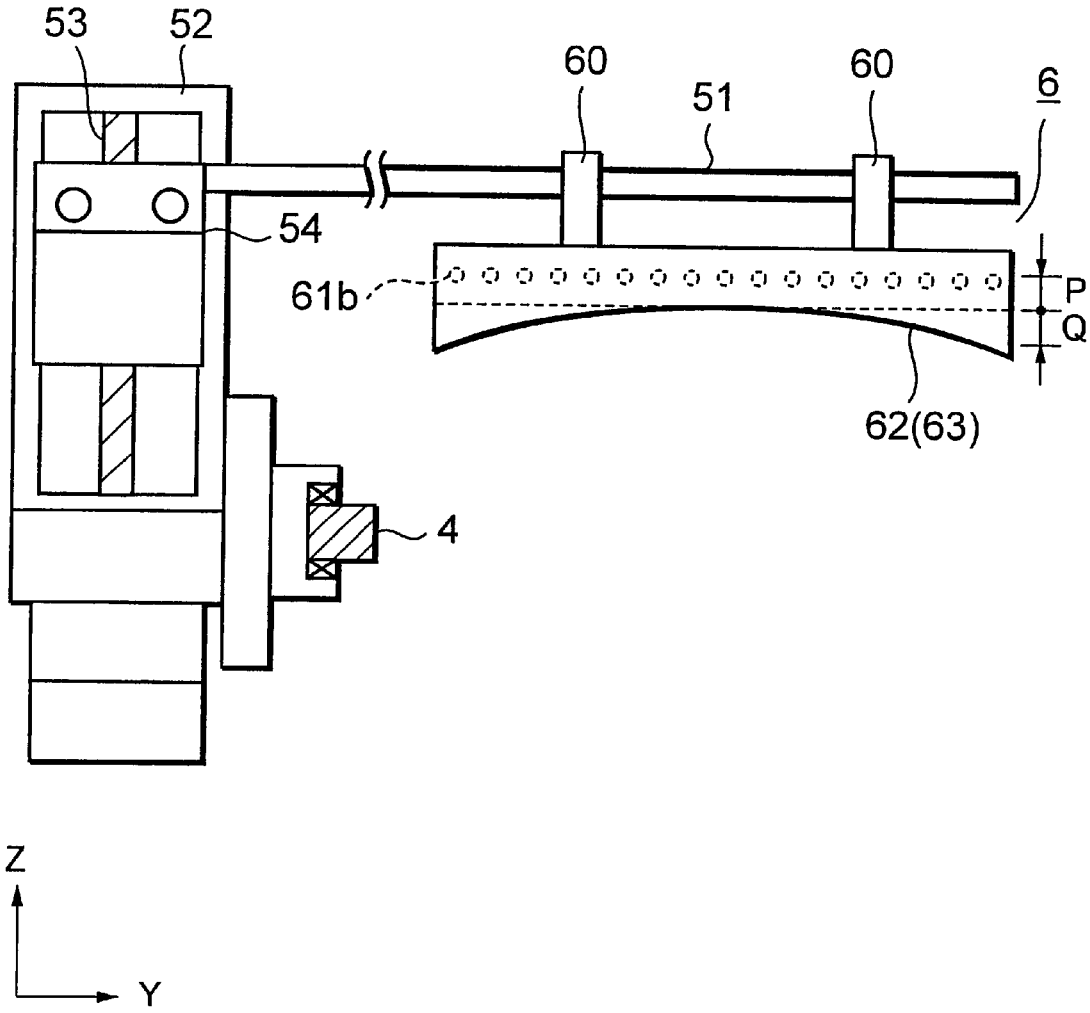
FIG. 3 is a side view showing a first moving mechanism of the solution processing apparatus of the first embodiment.

The first moving mechanism 5 is explained by means of FIG. 3. An arm section 51 for supporting the supply nozzle 6 can be moved along the guide rail 4 via a base section 52 as a moving section. The base section 52 has a raising and lowering mechanism 54 comprising, for example, a ball screw mechanism 53 and the like, and can move (up and down) the arm section 51 in a Z-direction by driving force from a power source (not shown) such as a motor.

Figure 4:
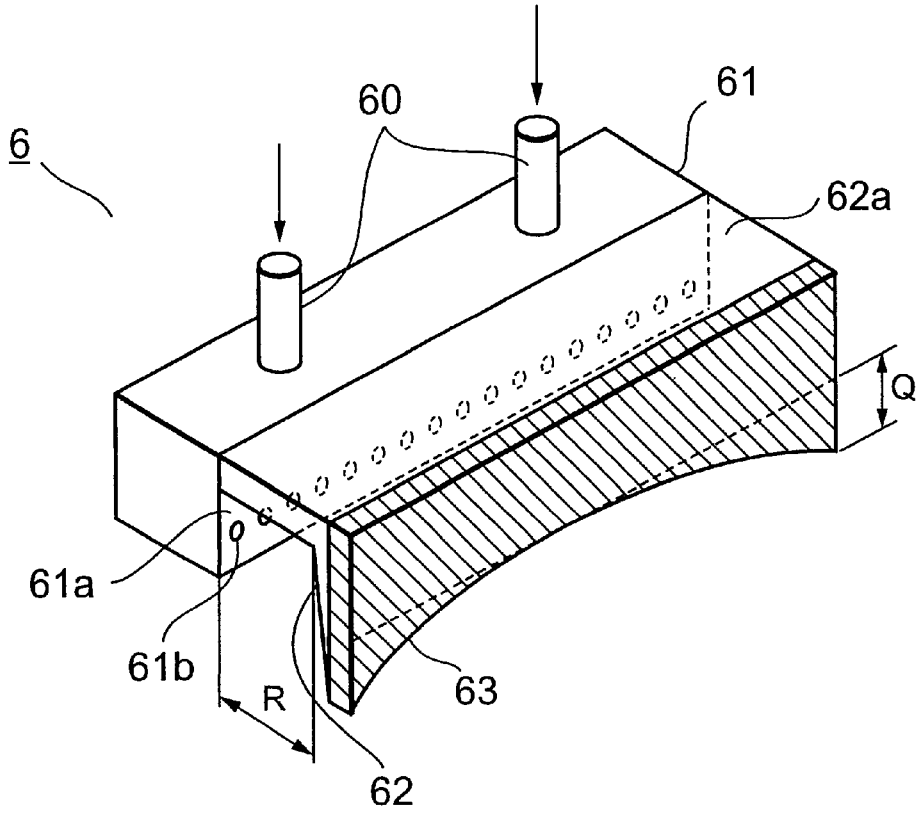
FIG. 4 is a perspective view showing a supply nozzle of the solution processing apparatus of the first embodiment.
Figure 5:
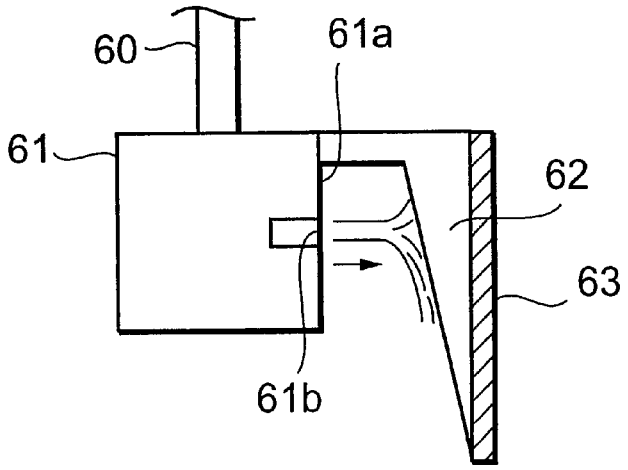
FIG. 5 is a sectional view showing the supply nozzle of the solution processing apparatus of the first embodiment.

As shown in FIG. 3 to FIG. 5, the supply nozzle 6 comprises a rod-shaped nozzle body 61 suspended from the arm section 51 while being supported by supporting members 6 and a guide plate 62 as a guide member. When the moving direction side of the supply nozzle 6 above the wafer W at the time of solution supply is defined here as "the front", and the opposite side is defined as "the back", in a front face 61*a* of the nozzle body 61, a large number of discharge ports 61*b* are provided at given intervals along a straight line over a length corresponding to the width of an effective area of a substrate, in this example, over a length corresponding to the diameter of the wafer W. The guide plate 62 is provided to face the front face 61*a*, in front of the front face 61*a* of the nozzle body 61 with an upper support plate 62*a* between them. When the guide plate 62 is seen from the moving direction side (the front side) of the supply nozzle 6, the lower edge portion thereof has a concave arc shape and goes down from the central portion toward the end portion. The central portion of the lower edge portion of the guide plate 62 is positioned at least lower than the discharge ports 61*b* in order to secure a catching area of a developing solution at this position, for example, positioned 10 mm lower than the center of the discharge port 61*b* (P in FIG. 3). When this embodiment is applied to the wafer W with a size of 12 inches, a difference of elevation Q between the central portion and both the end portions of the lower edge of the guide plate 62 is about 10 mm to 20 mm.

The guide plate 62 is made of, for example, a hydrophilic member, and structured to incline so that a guide face (a face opposite to the front face 61*a* of the nozzle body 61) for guiding the developing solution from the discharge ports 61*b* becomes further away from the front face 61*a* toward the lower edge. A hydrophobic member 63 is closely attached to a front face of the guide plate 62. The guide plate 62 tapers off to the lower edge portion. A narrow horizontal bottom face which is the lower edge of the hydrophobic member 63 is continuous with the forward end of the lower edge portion of the guide plate 62. Although the discharge ports 61*b* and the guide face of the guide plate 62 are shown apart from each other in FIG. 3 because of simplified drawing, actually they are closer to each other. A distance R between the discharge ports 61*b* and the guide face at a height where the developing solution hits on the guide face is, for example, about 5 mm to 10 mm.

The drive section 20, the first moving mechanism 5, and the second moving mechanism 41 which are described above are connected to a control section 7. Accordingly, the drive section 20, the first moving mechanism 5, and the second moving mechanism 41 can be controlled in association with one another, so that, for example, the supply (scanning) of a processing solution by the first moving mechanism 5 is performed concomitantly with the ascent and descent of the spin chuck 2 by the drive section 20. Moreover, the cup 3, the first moving mechanism 5, and the second moving mechanism 41 are formed as one unit surrounded by a box-shaped casing 8, and the wafer W is transferred by a transfer arm not illustrated, which will be described later.

Next, operation in this embodiment will be explained. The spin chuck 2 first ascends to the upper portion of the cup 3, and receives the wafer W which has been already coated with a resist and subjected to exposure processing in previous processes from the transfer arm not illustrated. The spin chuck 2 then descends until the wafer W reaches a given position shown by a full line in FIG. 1.

Subsequently, the first moving mechanism 5 is guided from an outer reference position of the outer cup 31 to a position corresponding to a point between the outer cup 31 and the peripheral edge of the wafer W along the guide rail 4, and then descends from this position to a waiting position outside the peripheral edge of the wafer W. At this time, the position (height) of the supply nozzle 6 is set at a height at which the developing solution is supplied onto the surface of the wafer W, whereby the lowermost edge portion of the guide plate 62 for guiding the developing solution to the surface of the wafer W is positioned, for example, 1 mm higher than the level of the surface of the wafer W.

The supply nozzle 6 then moves from one end side of the wafer W to the other end side thereof while discharging the developing solution from the position to the postion to which the nozzle descends (FIG. 6A). The developing solution discharged from each of the discharge ports 61*b* in a horizontal direction hits on the guide plate 62 and flows down along the guide face. The developing solution flowing down along the guide face is attracted to the guide plate 62 by surface tension at the lower edge portion of the guide plate 62, and besides the lower edge portion goes down toward both the ends of the guide plate 62. Thereby, part of the developing solution flows down to both edge sides of the wafer W along the lower edge of the guide plate 62 by the influence of gravity, and thus more developing solution is supplied to the peripheral edge portion of the wafer W compared with the central portion of the wafer W. The hydrophobic member 63 repels the developing solution, which is attracted to the lower edge portion of the guide plate 62 by surface tension and is about to go forward, backward, and the developing solution drips down to the surface of the wafer W from the tapered lower edge portion.

After the completion of application of the developing solution, the wafer W stands still. The first moving mechanism 5 returns to the waiting section 42 being the reference position, and in place of the first moving mechanism 5, the second moving mechanism 41 moves from the waiting section 43 to the wafer W side. The second moving mechanism 43 is positioned so that a discharge section of the cleaning nozzle 40 is situated in a position above the center of the wafer W. Simultaneously with this, the spin chuck 2 rotates, and a cleaning solution, for example, pure water is supplied to the central portion of the wafer W and spread from the central portion to the peripheral edge portion of the wafer W by centrifugal force of the wafer W, whereby the developing solution is rinsed away. Then, after the completion of processes such as spin-drying and the like, developing processing for the wafer W is completed.

According to the embodiment of the present invention as described above, since the guide plate 62 is provided in the supply nozzle 6 and temporarily catches the developing solution discharged from the discharge ports 61*b* with the guide face having an inclination to lower its discharge pressure, the discharge pressure of the developing solution itself does not reflect the supply pressure thereof onto the wafer W. Accordingly, the impact of a collision of the developing solution against the surface of the wafer W is alleviated. As a result, micro bubbles are prevented from appearing on the wafer W, thereby reducing poor developing.

Figure 12:
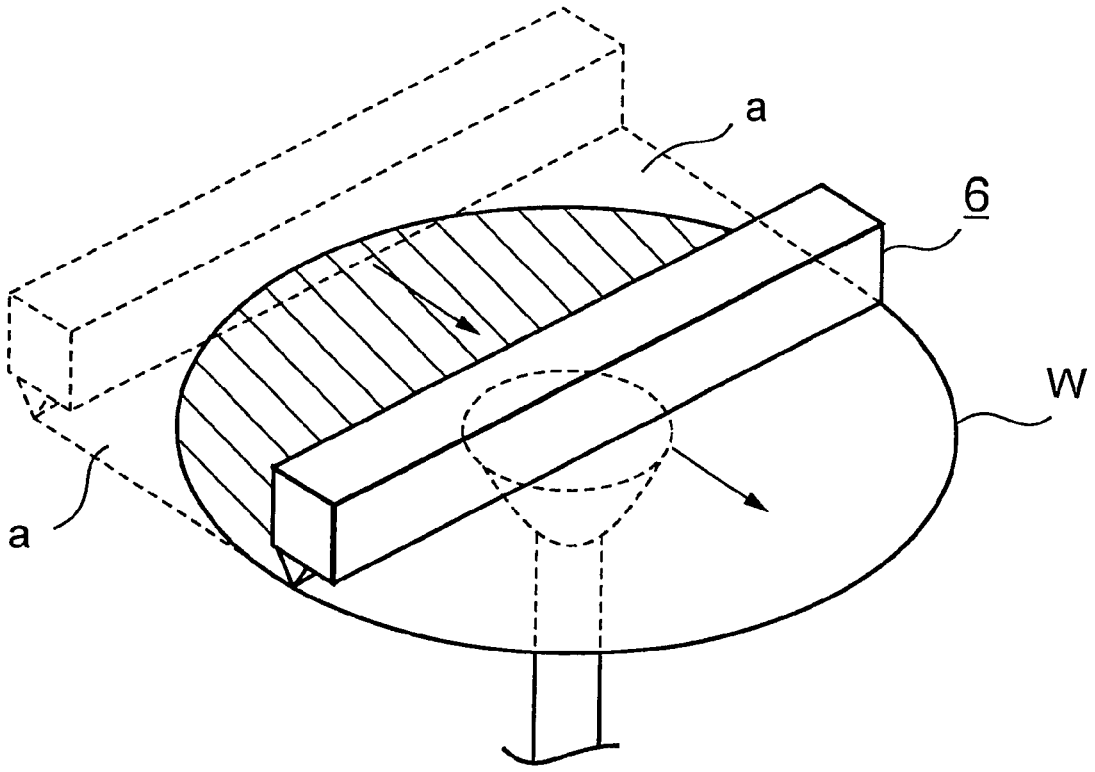
FIG. 12 is an explanatory view showing the solution processing apparatus applying a scan method.

Since the spin chuck vacuum-sucks the wafer W from the center of the back face side, a little distortion occurs in the wafer W, whereby the developing solution supplied to the surface of the wafer W tends to concentrate at the center. Moreover, in the case of a scan method, at the edge portion of the wafer W shown by the symbol a in FIG. 12, the developing solution spills to the outside of the wafer W, and part of the developing solution spilling to the outside of the wafer W at this time is attracted to the inside of the wafer W by the surface tension of the developing solution applied on the surface of the wafer W. As a result, a waviness phenomenon occurs on the surface of the wafer W, and thus the developing solution concentrates at the central portion of the wafer W. Hence, a solution film at the central portion of the wafer W is thicker than at the edge portion, which causes a problem that line width becomes ununiform. In this embodiment, however, the lower edge portion of the guide plate 62 is formed into an arc shape, whereby a supply quantity to the peripheral edge portion of the wafer W is larger than a supply quantity to the central portion thereof. As a result, a solution film with high in-plane uniformity is formed owing to a balance with a phenomenon in which the developing solution concentrates at the central portion of the wafer W, leading to increased uniformity of line width of a pattern.

Furthermore, the guide plate 62 is made of the hydrophilic member and the hydrophobic member 63 is provided on the front face (the moving direction side) of the guide plate 62, which prevents the developing solution from moving around to the front side.

If the developing solution moves around to the front side, there is a possibility that a portion to which the developing solution moves around and a portion to which it does not move around come to exist since the developing solution does not uniformly move around. This makes the developing ununitorm.

However, according to this embodiment, since the hydrophilic guide plate 62 and the hydrophobic member 63 are provided, the developing solution can be supplied uniformly, thereby reducing developing ununiformity.

FIG. 7 shows a second embodiment according to the present invention. The supply nozzle 6 shown in FIG. 7 is structured so that in the same supply nozzle as in the embodiment shown in FIG. 5, the direction and height of the discharge port 61*b* discharging the solution in the horizontal direction is changed to allow the developing solution to be discharged from a position higher than that in the apparatus in FIG. 5 diagonally downward in the moving direction of the supply nozzle 6. In this apparatus, unlike FIG. 5, the guide face of the guide plate 62 has no inclination. In such structure, the same operational effect can be obtained.

Figure 8A:
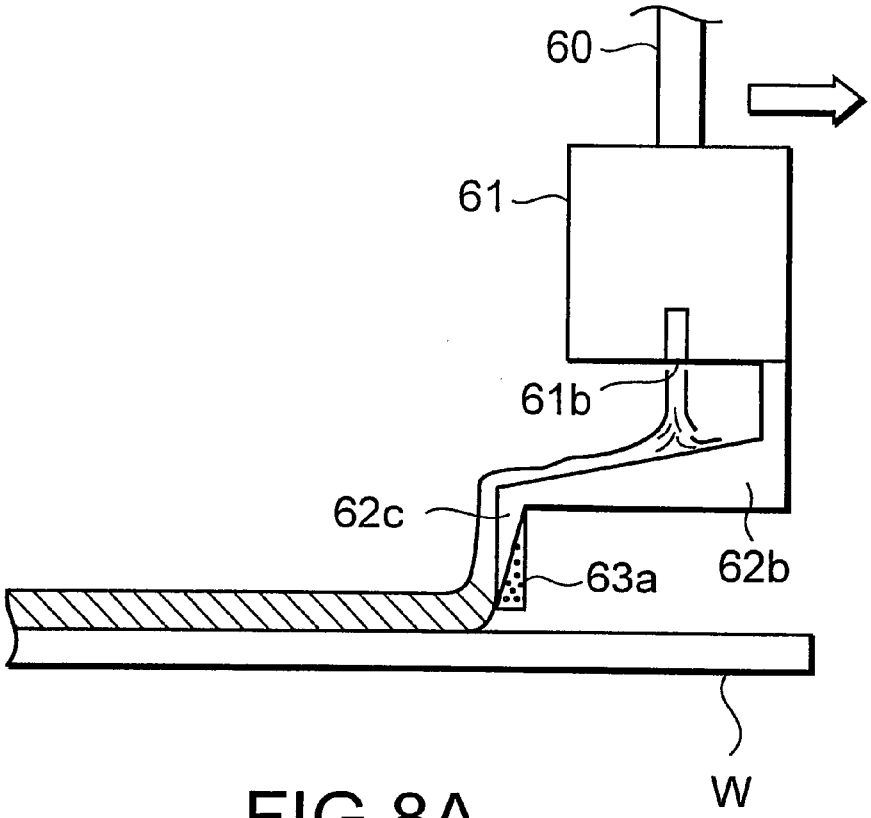
FIGS. 8A and 8B are explanatory views showing operation of the solution processing apparatus of a third embodiment according to the present invention.
Figure 8B:
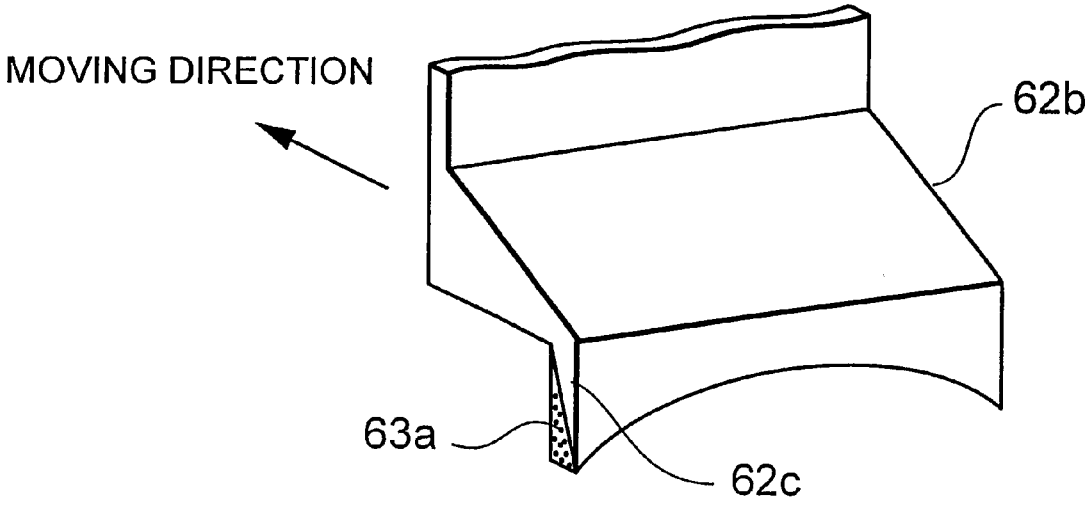

As a third embodiment, as shown in FIG. 8A and FIG. BB, the discharge port 61*b* may be positioned to face vertically downward, and the guide plate 62 may be positioned under the nozzle body 61. In the guide plate 62 in this apparatus, an inclined face portion 62*b* inclining backward in the moving direction shown by the arrows in FIG. 8A and FIG. 8B is supported by the front end of the nozzle body 61, and a vertical face portion 62*c* bent vertically downward is formed at the back end portion of the inclined end portion 62*b*. The lower edge portion of the vertical face portion 62*c* is formed into an arc shape, and a hydrophobic member 63*a* is provided on the entire face on the front side of the vertical face portion 62*c* so as to have broader width toward the bottom, whereas the back side of the vertical face portion 62*c* made of a hydrophilic member has narrower width toward the bottom. Such an apparatus can also yield uniform developing processing similarly to the supply nozzle shown in FIG. 5.

Figure 9:
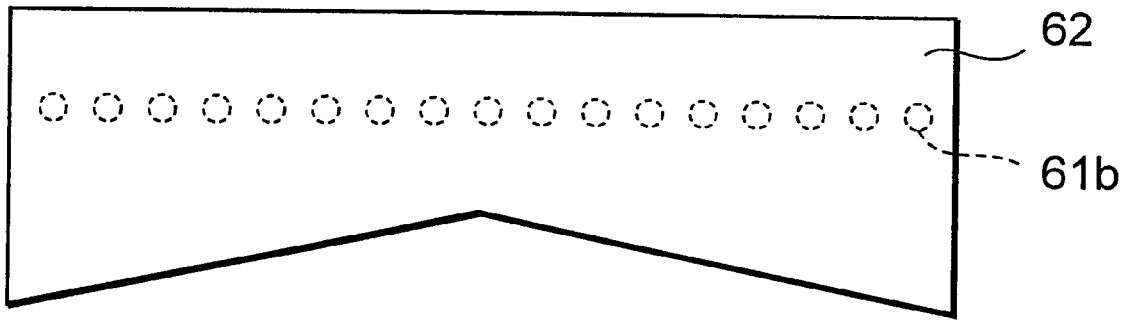
FIG. 9 is an explanatory view showing operation of the solution processing apparatus of a third embodiment according to the present invention.

Furthermore, as a fourth embodiment, as shown in FIG. 9, the lower edge portion of the guide plate 62 of the supply nozzle 6 may incline downward linearly from the central portion to both the ends, or may go down stepwise.

Figure 13:
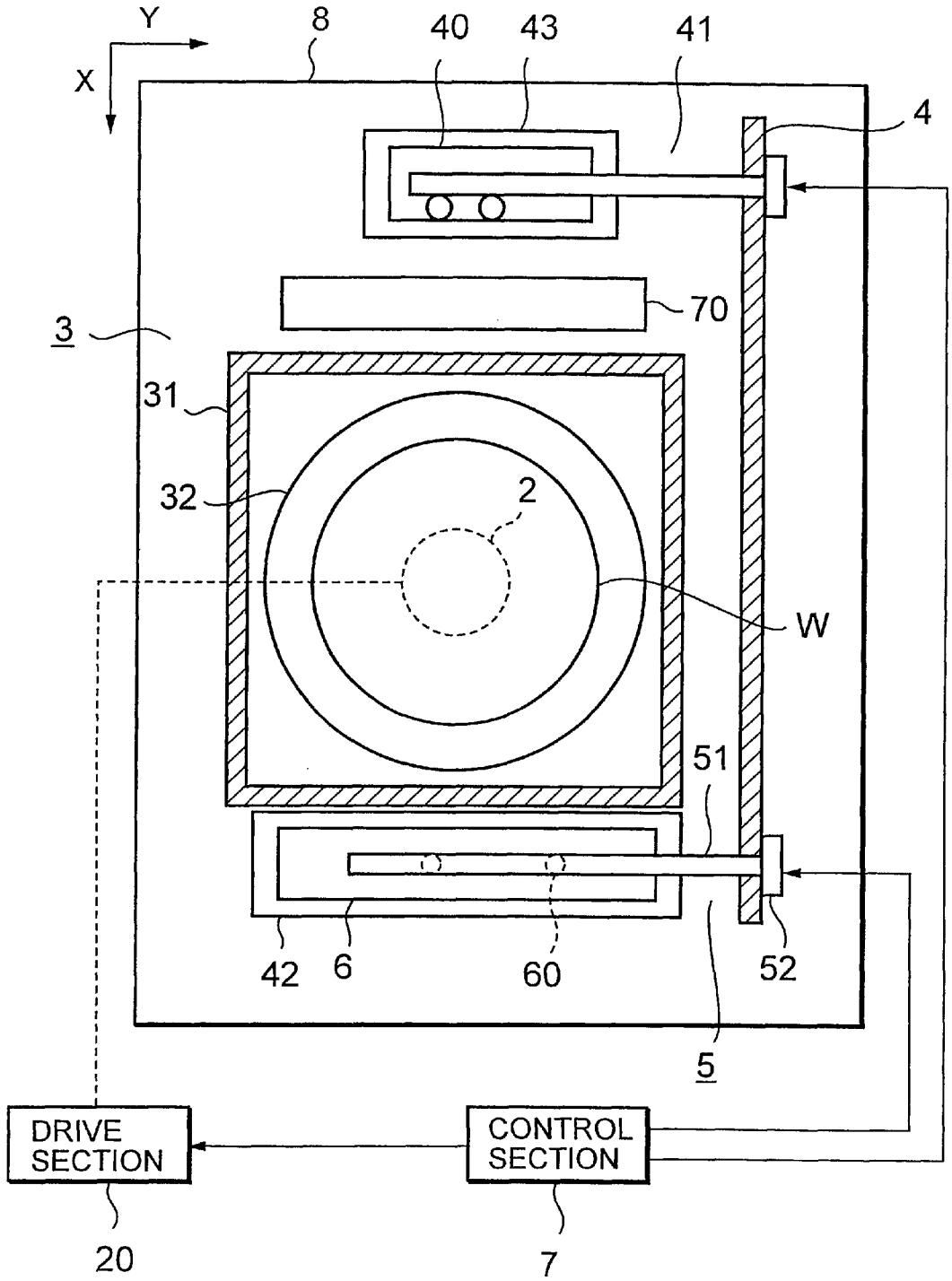
FIG. 13 is a plan view showing the solution processing apparatus of a fifth embodiment according to the present invention.
Figure 14:
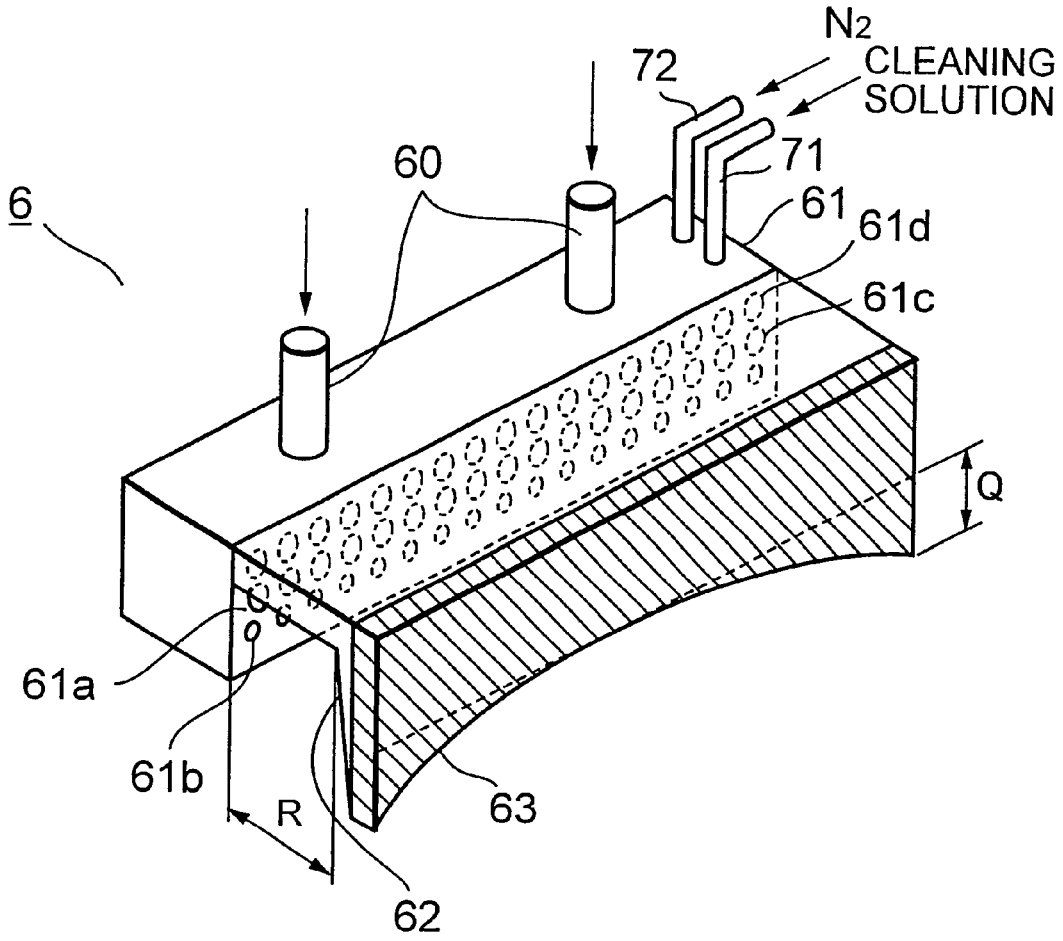
FIG. 14 is a perspective view showing a supply nozzle of the solution processing apparatus of the fifth embodiment.

FIG. 13 to FIG. 15 show a fifth embodiment according to the present invention. As shown in FIG. 13, the fifth embodiment differs from the first embodiment in that a drying section 70 is provided between the outer cup 31 and the waiting section 43 in the solution processing apparatus. Moreover, as shown in FIG. 14, it differs from the first embodiment in that in addition to the discharge ports 61*b* for discharging the developing solution, discharge ports 61*c* for discharging the cleaning solution supplied through a cleaning solution supply pipe 71 to the guide plate 62 and discharge ports 61*d* for discharging an inert gas, for example, nitrogen gas supplied through an inert gas supply pipe 72 to the guide plate 62 are provided in the front face 61*a* of the nozzle body 61. A plurality of discharge ports 61*c* are provided adjacent to the discharge ports 61*b*, and a plurality of discharge ports 61*d* are provided adjacent to the discharge ports 61*c*, respectively over a length corresponding to the diameter of the wafer W.

Figure 15A:
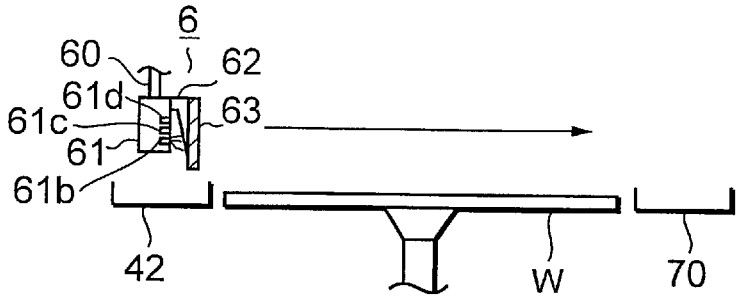
FIGS. 15A to 15E are explanatory views showing the action of the solution processing apparatus of the fifth embodiment.
Figure 15B:
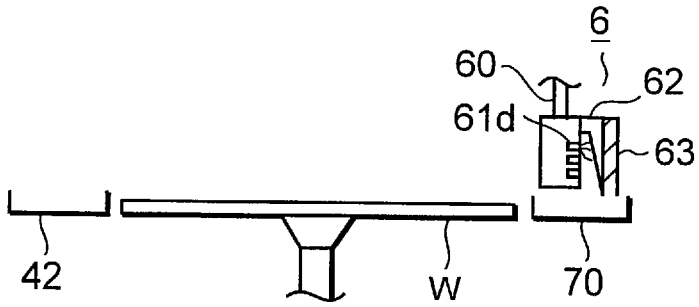
Figure 15C:
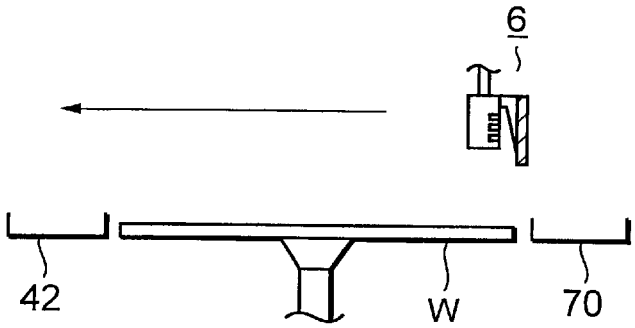
Figure 15D:
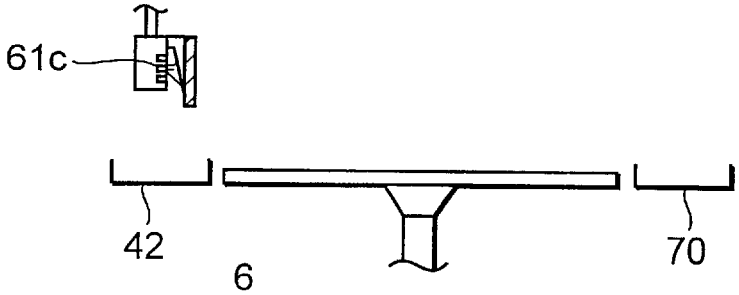
Figure 15E:
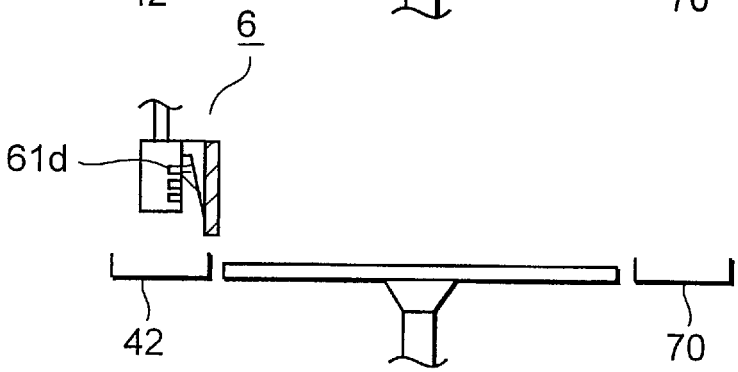

Next, the action of the supply nozzle 6 in the process of applying the developing solution in the fifth embodiment will be explained. As shown in FIG. 15A, the supply nozzle 6 moves over the wafer W from the waiting section 42 to the drying section 70 while discharging the developing solution from the discharge ports 61*b*. After moving to the position of the drying section 70, the supply nozzle 6 temporarily stops, and the discharge of the developing solution is also stopped. When the supply nozzle 6 is positioned at the drying section 70, nitrogen gas is supplied from the discharge ports 61*d* onto the guide plate 62 as shown in FIG. 15B. Thereby, the developing solution adhering to the guide plate 62 can be removed, and hence the developing solution never drips onto the wafer W when the supply nozzle 6 moves from the drying section 70 to the waiting section 42 in the following process. After the developing solution adhering to the guide plate 62 is removed in the drying section 70, the supply nozzle moves over the wafer W to the waiting section 42 as shown in FIG. 15C. When the supply nozzle 6 returns to the waiting section 42, the cleaning solution is supplied to the guide plate 62 from the discharge ports 61c as shown in FIG. 15D, whereby the developing solution remaining on the guide plate 62 can be fully removed, and old and new developing solutions are never mixed when the developing solution is discharged to the wafer W to be processed next. After the guide plate 62 is cleaned, nitrogen gas is supplied to the guide plate 62 from the discharge ports 61*d* to thereby dry the guide plate 62 as shown in FIG. 15E. After the completion of the application of the developing solution, cleaning by the used of the cleaning nozzle 40 is performed as in the case of the first embodiment.

As described above, a cleaning mechanism for cleaning the guide plate 62 can be provided in the supply nozzle 6.

Figure 16:
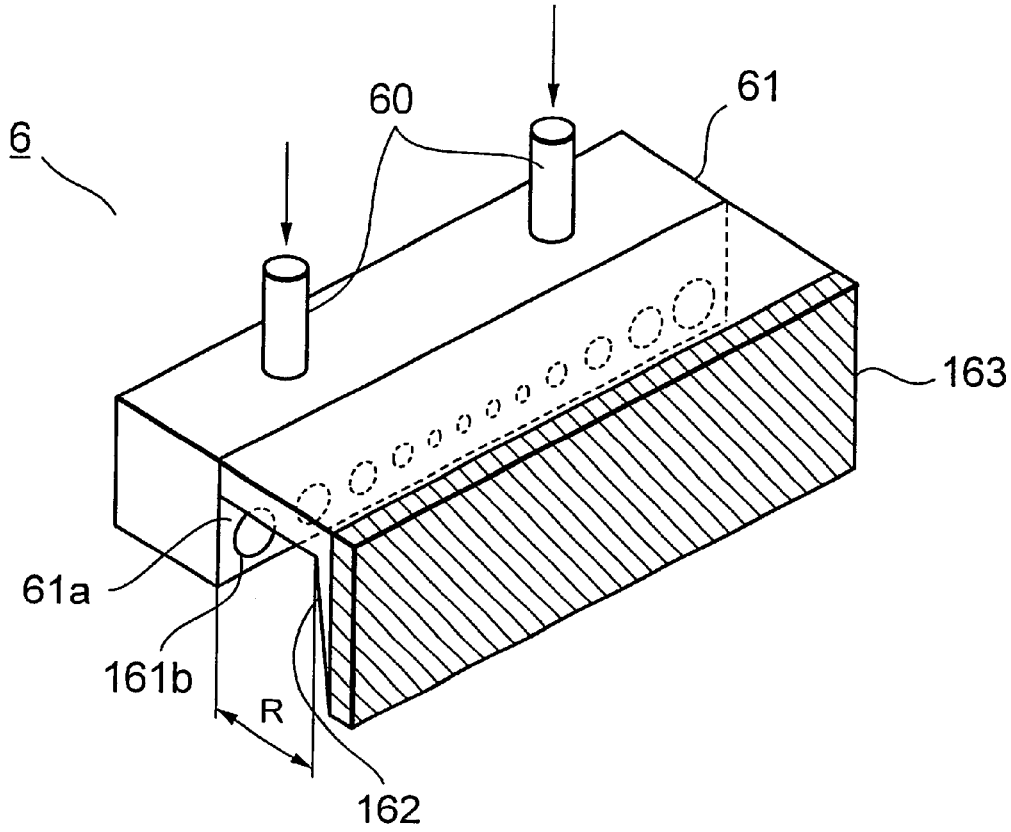
FIG. 16 is a perspective view showing the solution processing apparatus of a sixth embodiment according to the present invention.

FIG. 16 is a perspective view showing the structure of the supply nozzle 6 in a sixth embodiment. In the first embodiment, when the guide plate 62 is seen from the moving direction side (the front side) of the supply nozzle 6, the lower edge portion thereof has a concave arc shape and goes down from the central portion toward the end portion, and the sizes of the plurality of discharge ports 61*b* for discharging the developing solution are equal. As shown in FIG. 16, however, the lower edge portion of a guide plate 162 may have a linear shape, and the sizes of a plurality of discharge ports 161*b* for discharging the developing solution may be designed to be larger from the central portion toward the end portion. Thanks to the aforesaid structure in which the sizes of the plurality of discharge ports 161*b* for discharging the developing solution are designed to be larger from the central portion toward the end portion, a supply quantity to the peripheral edge portion of the wafer W is larger than a supply quantity to the central portion thereof. As a result, a solution film with high in-plane uniformity is formed owing to balance with a phenomenon in which the developing solution concentrates at the central portion of the wafer W by the aforesaid spin chuck and scan method, leading to increased uniformity of line width of a pattern.

Figure 17:
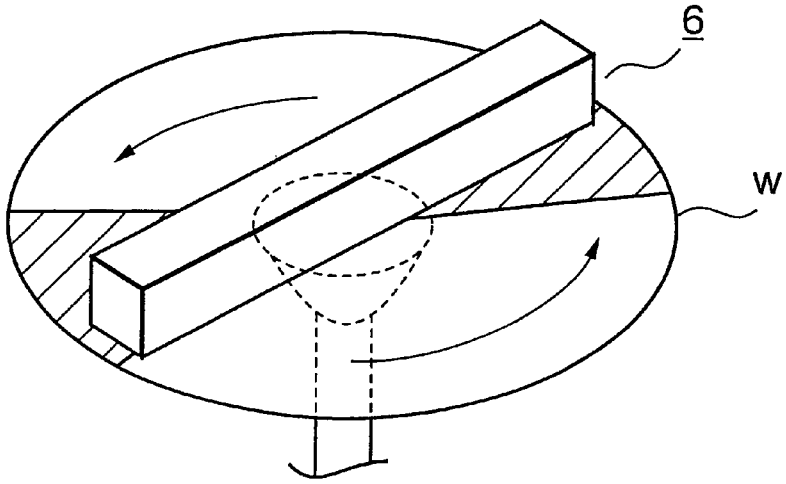
FIG. 17 is a perspective view showing the solution processing apparatus of a seventh embodiment according to the present invention.

FIG. 17 shows a developing solution supplying method in the solution processing apparatus in a seventh embodiment. The aforesaid embodiments are explained with the scan method, in which the supply nozzle is moved to and disposed on the outside of the peripheral edge of the wafer W horizontally held by the spin chuck, and from this position, moved to the outside of the opposite side of the wafer peripheral edge, as the example. However, as shown in FIG. 17, the supply nozzle with the guide plate can be used also in the following rotation method. In other words, while the center of the wafer is vacuum-sucked by the spin chuck, the supply nozzle is positioned so that the discharge ports lie, for example, 1 mm higher than the surface of the wafer at the central portion of the wafer. The wafer is rotated 180 degrees while the developing solution is being discharged from the discharge ports to the central portion of the surface of the wafer in the diameter direction. Namely, by using the supply nozzle with the guide plate, the impact of a collision of the developing solution against the surface of the wafer W is alleviated, which inhibits micro bubbles from appearing on the wafer W, thereby reducing poor developing.

In such a rotation method, more developing solution is supplied to the central portion of the wafer W than to the edge portion of the wafer W if the same quantity of developing solution is discharged from each of the plurality of the discharge ports, which causes a problem that line width becomes ununiform since a solution film at the central portion of the wafer W becomes thicker than at the edge portion. However, by performing such a design that the quantity of the developing solution supplied to the peripheral edge portion of the wafer W becomes larger than that to the central portion thereof by changing the shape of the guide plate of the supply nozzle and the sizes of discharge ports as described above, a solution film with high in-plane uniformity is formed, resulting in increased uniformity of line width of a pattern.

Moreover, when a little distortion occurs in the wafer W by the spin chuck, the developing solution supplied to the surface of the wafer W tends to concentrate at the center. In this case, by changing the shape of the guide plate of the supply nozzle and the sizes of discharge ports as described above, the quantity of the developing solution supplied to the peripheral edge portion of the wafer W is set to be larger than that to the central portion thereof, and consequently a solution film with high in-plane uniformity is formed, whereby the uniformity of line width of a pattern is raised.

Incidentally, in the rotation method, in the vicinity of the center of a semiconductor wafer across which the supply nozzle lies, there is a possibility that new and old developing solutions are mixed because portions at which a developing solution discharged first and a developing solution discharged last overlap each other are formed, whereby developing advances further and the uniformity of line width around the center is marred, whereas in the scan method, new and old developing solutions are not mixed.

The solution processing apparatus according to the aforesaid embodiments is not limited to developing processing, and can be applied to coating processing with a resist, coating processing with a precursor material of a silicon oxide film.

Figure 10:
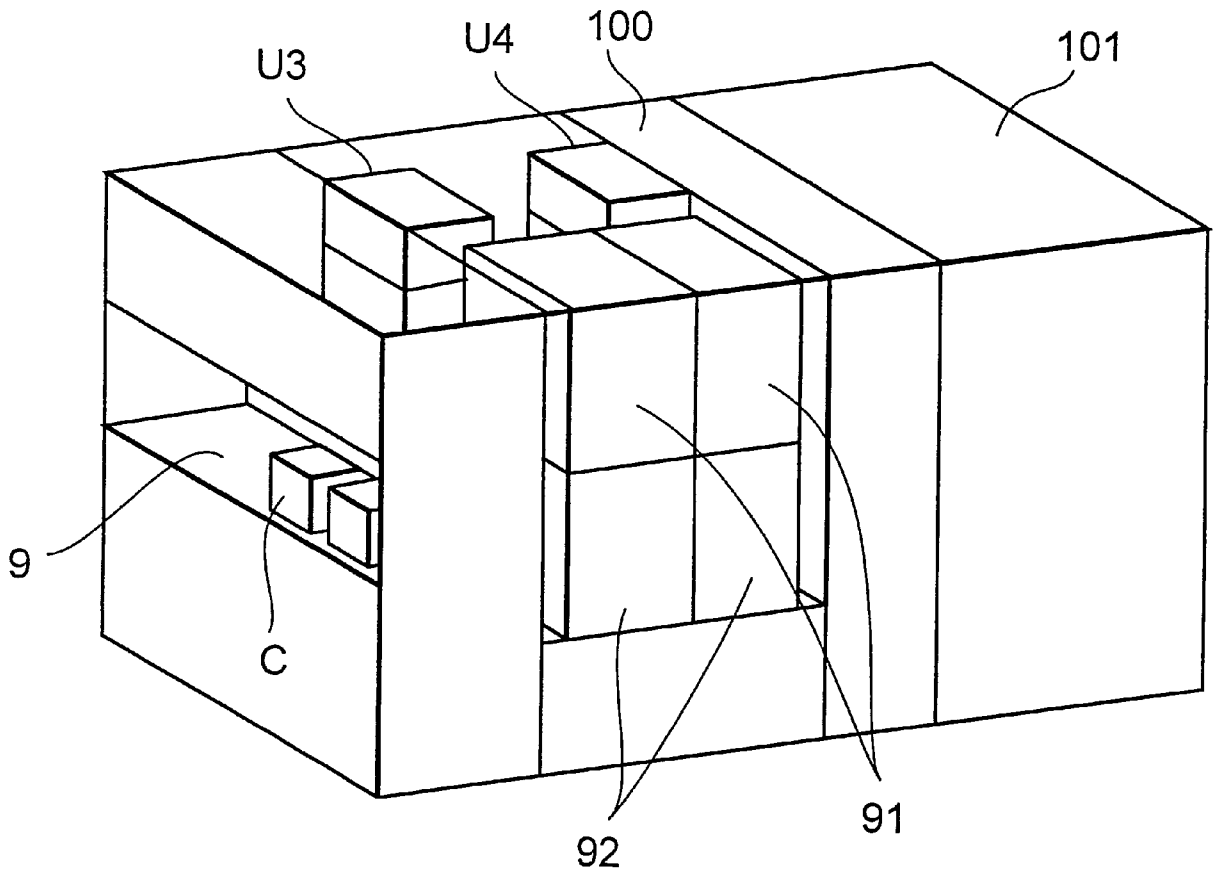
FIG. 10 is a perspective view showing one example of a coating and developing apparatus into which the solution processing apparatus is incorporated.
Figure 11:
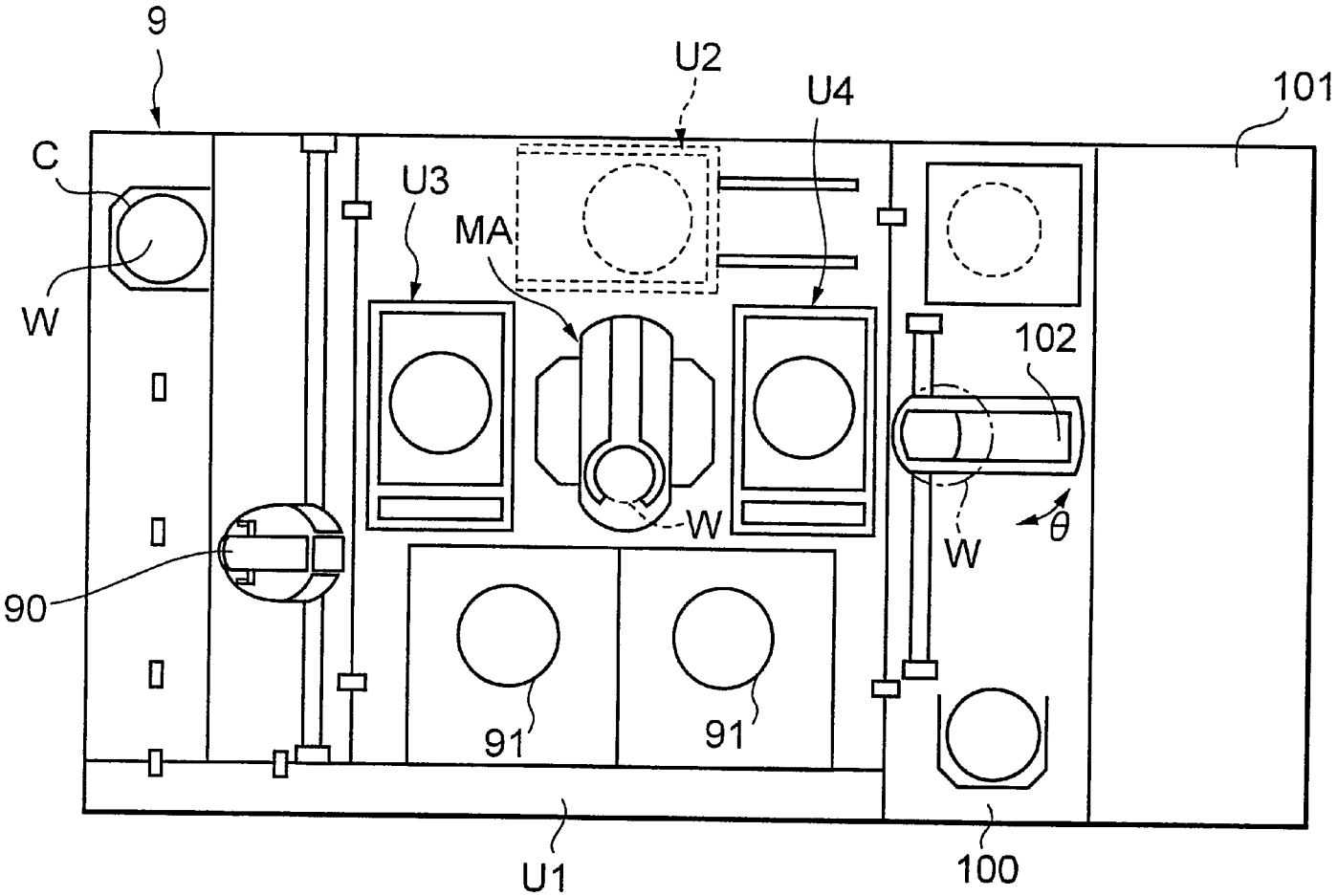
FIG. 11 is a plan view showing the one example of the coating and developing apparatus into which the solution processing apparatus is incorporated.

Next, a general idea of an example of a coating and developing apparatus into which the aforesaid developing apparatus is incorporated as a unit will be explained with reference to FIG. 10 and FIG. 11. In FIG. 10 and FIG. 11, the numeral 9 is an in/out stage for carrying a wafer cassette in and out, and a cassette C housing, for example, 25 wafers W is mounted thereon, for example, by an automatic transfer robot. In a region facing the in/out stage 9, a delivery arm 90 for the wafer W is provided to freely move in the X- and Y-directions and rotate in a θ-direction (rotate around a vertical axis). When seen from the in/out stage 9, at the back of the delivery arm 90, a coating and developing system unit u1 is arranged on the right side, and heating and cooling system units u2, u3, and u4 are arranged respectively on the left side, the front side, and the back side. A wafer transfer arm MA, structured to be ascendable and descendable, movable right and left, and back and forth, and rotatable around a vertical axis, for transferring the wafer W between the coating and developing system unit and heating and cooling system units is provided. In FIG. 10, however, the unit u2 and the wafer transfer arm MA are not shown for convenience.

In the coating and developing system unit, for example, two developing units 91 including the aforesaid developing apparatus are disposed at the upper stage, and two coating units 92 are disposed at the lower stage. In the heating and cooling system unit, a heating unit, a cooling unit, a hydrophobic unit, and the like are vertically stacked.

When the aforesaid section including the coating and developing system unit and the heating and cooling system units is called a clean track, at the back of the clean track, an aligner 101 is connected thereto with an interface unit 100 therebetween. The interface unit 100 transfers the wafer W between the clean track and the aligner 101, for example, by using a wafer transfer arm 102 structured to be ascendable and descendable, movable right and left, and back and forth, and rotatable around a vertical axis.

The flow of the wafer in this apparatus will be explained. First, the wafer cassette C housing the wafers W is carried into the in/out stage 9 from the outside, and the wafer W is taken out of the cassette C by the wafer transfer arm 90, and delivered to the wafer transfer arm MA through a delivery table which is one shelf of the heating and cooling system unit u3. Subsequently, after being subjected to hydrophobic processing in a processing section in one shelf of the unit u3, the wafer W is coated with a resist solution in the coating unit 92, whereby a resist film is formed. After being heated in the heating unit, the wafer W coated with the resist film is sent to the aligner 101 through the interface unit 100, and the wafer W undergoes exposure through a mask corresponding to a pattern there.

Then, after being heated in the heating unit, the wafer W is cooled in the cooling unit and sent to the developing unit 91 to undergo developing processing, and a resist mask is formed. Thereafter, the wafer W is returned into the cassette C on the in/out stage 9.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A solution processing apparatus, comprising:

a substrate holding section which horizontally holds a substrate;

a supply nozzle having a plurality of discharge ports configured to discharge a processing solution and arranged over a length corresponding to the width of an effective area of the substrate;

a moving mechanism configured to move said supply nozzle relatively to the substrate in a direction orthogonal to the direction of arrangement of the discharge ports; and a guide member provided opposite to said supply nozzle and configured to guide the processing solution discharged from said discharge ports to the surface of the substrate, said guide member having a central portion and side portions lowered from said central portion.

2. The apparatus as set forth in claim 1, wherein said side portions are curved downwardly from said central portion or linearly lowered therefrom.

3. The apparatus as set forth in claim 1, wherein said guide member has a hydrophilic member made of a hydrophilic material for guiding the processing solution discharged from said supply nozzle to the substrate.

4. The apparatus as set forth in claim 3, wherein said guide member has a hydrophobic member made of a hydrophobic material on an outer side of said guide member, said hydrophobic member being closely attached to said hydrophilic member.

5. The apparatus as set forth in claim 1, wherein the discharge ports of said supply nozzle are arranged so as to discharge the processing solution in a moving direction of said supply nozzle, and said guide member is provided facing the discharge ports.

6. The apparatus as set forth in claim 1, wherein said substrate holding section comprises a spin chuck which suction-holds a central portion of the substrate.

7. A solution processing apparatus, comprising:

a substrate holding section configured to horizontally hold a substrate;

a supply nozzle having a plurality of discharge ports configured to discharge a processing solution and arranged over a length corresponding to a width of an effective area of the substrate;

a moving mechanism configured to move said supply nozzle relatively to the substrate; and a guide member provided for said supply nozzle and configured to guide the processing solution discharged from the discharge ports to a surface of the substrate, wherein a quantity of the processing solution supplied to an edge portion of the substrate is larger than that of the processing solution supplied to a central portion thereof.

8. The apparatus as set forth in claim 7, wherein said moving mechanism is a mechanism configured to move said supply nozzle relatively to the substrate in a direction orthogonal to a direction of arrangement of the discharge ports.

9. The apparatus as set forth in claim 7, wherein said moving mechanism is constructed by a rotating mechanism configured to rotate the substrate, and said supply nozzle is positioned to pass through a point very close to the center of the substrate when the substrate is rotated by said rotation mechanism.

10. The apparatus as set forth in claim 7, which further comprises a plurality of cleaning solution discharge ports configured to discharge a cleaning solution and arranged in said supply nozzle over the length corresponding to the width of the effective area of the substrate, the cleaning solution discharged from the cleaning solution discharge ports being supplied to said guide member to clean it.

11. The apparatus as set forth in claim 7, which further comprises a plurality of gas discharge ports configured to discharge gas and arranged in said supply nozzle over the length corresponding to the width of the effective area of the substrate, the gas discharged from the gas discharge ports being supplied to said guide member to remove the processing solution remaining on said guide member.

12. The apparatus as set forth in claim 11, wherein the gas is an inert gas.

13. The apparatus as set forth in claim 7, wherein said guide member includes a central portion and side end portions lowered than the central portion.

14. The apparatus as set forth in claim 7, wherein said discharge ports are arranged in said supply nozzle along the width direction of the effective are of the substrate, a size of each of the discharge ports located at side portions being larger than at least one of the discharge ports located at a central portion.

15. The apparatus as set forth in claim 7, wherein said substrate holding section is constituted by a spin chuck which suction-holds a central portion of the substrate.

16. A solution processing apparatus, comprising:

a substrate holding section configured to horizontally hold a substrate;

a supply nozzle having a plurality of discharge ports configured to discharge a processing solution and arranged over a length corresponding to a width of an effective area of the substrate;

a moving mechanism configured to move said supply nozzle relatively to the substrate; and a guide member provided for said supply nozzle to guide the processing solution discharged from the discharge ports to a surface of the substrate, said guide member having a central portion and both end portions lowered than the central portion.

17. The apparatus as set forth in claim 16, wherein said end portions are curved downwardly from said central portion or linearly lowered therefrom.

18. The apparatus as set forth in claim 16, wherein said guide member has a hydrophilic member made of a hydrophilic material for guiding the processing solution discharged from said supply nozzle to the substrate.

19. The apparatus as set forth in claim 18, wherein said guide member has a hydrophobic member made of a hydrophobic material on an outer side of said guide member, said hydrophobic member being closely attached to said hydrophilic member.

20. The apparatus as set forth in claim 16, wherein the discharge ports of said supply nozzle are arranged to discharge the solution to a moving direction of said supply nozzle, and said guide member is provided facing the discharge ports.

21. The apparatus as set forth in claim 16, wherein said substrate holding section is constituted by a spin chuck which suction-holds a central portion of the substrate.

* * * * *